United States Patent [19]

Jones

[11] 4,121,207

[45] Oct. 17, 1978

[54] SWITCH FOR INDICATING BRUSH WEAR

[75] Inventor: Francis L. Jones, Mentor, Ohio

[73] Assignee: Towmotor Corporation, Mentor, Ohio

[21] Appl. No.: 816,633

[22] Filed: Jul. 18, 1977

[51] Int. Cl.[2] ..... G08B 21/00

[52] U.S. Cl. ..... 340/648; 200/61.4

[58] Field of Search ..... 340/267 R, 248 E; 200/61.4, 61.41

[56] References Cited

U.S. PATENT DOCUMENTS 3,523,288 8/1970 Thompson ..... 340/267 R 4,024,525 5/1977 Baumgartner et al. ..... 200/61.41

*Primary Examiner*—Glen R. Swann, III

*Attorney, Agent, or Firm*—Phillips, Moore, Weissenberger, Lempio & Majestic

[57] ABSTRACT

A brush presses against the commutator of a machine, slidably movable within a brush holder, and an arm operatively associated with a switch has a roller in rolling contact with a side of the brush through an opening of the holder, such that upon sufficient wear of the brush, a resilient spring urges the roller over the trailing end of the brush to operate the switch to complete a current path.

8 Claims, 5 Drawing Figures

SWITCH FOR INDICATING BRUSH WEAR

BACKGROUND OF THE INVENTION

Machines such as motors or generators include a commutator fixed to the rotating armature and electrically connected to the armature windings, the armature being electrically connected to an external power circuit through brushes which engage the rotating commutator. The brushes are usually made up of a mixture of carbon particles and a binder material, such as graphite or a metallic powder. As the commutator rotates, the contact faces of the brushes gradually wear away. In order to maintain electrical contact, the brushes are slidably mounted in stationery brush holders on a yoke surrounding the commutator, the brushes being spring-pressed into engagement with the commutator. Wearing of the brushes causes them to shorten in length and eventually they must be replaced. If a brush is allowed to wear too much before replacement, the metal securement of the pigtail connection to the brush will engage the commutator and cause detrimental scoring thereof.

SUMMARY OF THE INVENTION

The present invention is directed to overcoming one or more of the problems as set forth above.

Broadly stated, the invention is in a brush wear indicator for a machine having a rotating commutator, a yoke surrounding the commutator, a brush holder on the yoke and carbon brush means mounted on the brush holder for translatory movement relative to the commutator. The brush means have a contact face spring-pressed against the commutator, an end opposite the contact face, and a generally straight side interconnecting the contact face and end opposite the contact face. The improvement comprises switch means, including arm means movable generally toward and away from the brush means to determine respective closed and opened states of the switch means, and resilient means operatively connected with the arm means for urging the arm means toward the brush means, the arm means including an arm means portion in contact with the generally straight side of the brush means, whereupon with sufficient wear of the brush means, the end of the brush means opposite the contact face reaches the arm means portion in contact with the generally straight side of the brush means, allowing the resilient spring means to move the arm means to provide a closed state of the contact means.

BRIEF DESCRIPTION OF THE DRAWINGS

Other objects of the invention will become apparent from a study of the following specification and drawings in which.

DESCRIPTION OF THE PREFERRED EMBODIMENT

Figure 1:
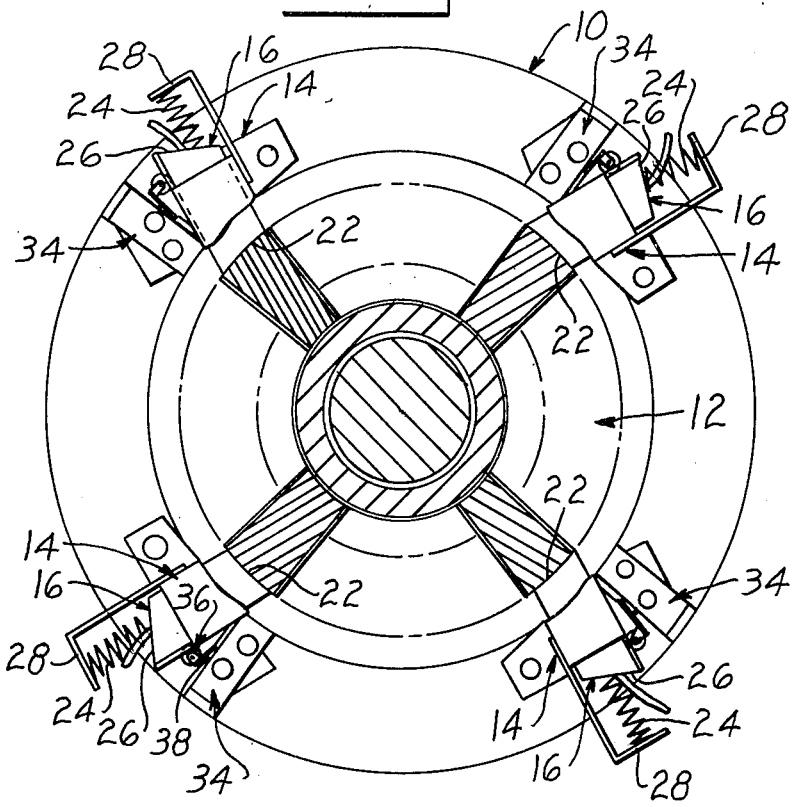
FIG. 1 is a view, partially in section, of a typical commutator and yoke arrangement incorporating the present invention.

Referring to the drawings, a conventional electrically non-conductive yoke 10 surrounds a commutator 12. The commutator 12 is, of course, rotatable, and the yoke 10 has mounted thereto a plurality of brush holders 14, in which are slidably mounted carbon brush means 16. Each carbon brush means 16 is made up of a pair of side-by-side carbon brushes 18, 20. The brush means 16 are capable of translatory movement toward and away from the commutator 12 by sliding thereof in the respective brush holders 1 as is well known. Each brush means 15 has a contact face 22 in contact with the commutator 12, and a spring 24 bears against the end 26 removed from the contact face 22 and a leg 28 secured to the holder 14, so that each respective contact face 22 is spring-pressed against the commutator 12. Each brush 18, 20 has a pigtail lead 30 secured thereto, as for example, by insertion of the end of the pigtail into a bore in the brush 18, 20, at the end thereof opposite the contact face 22.

Figure 2:
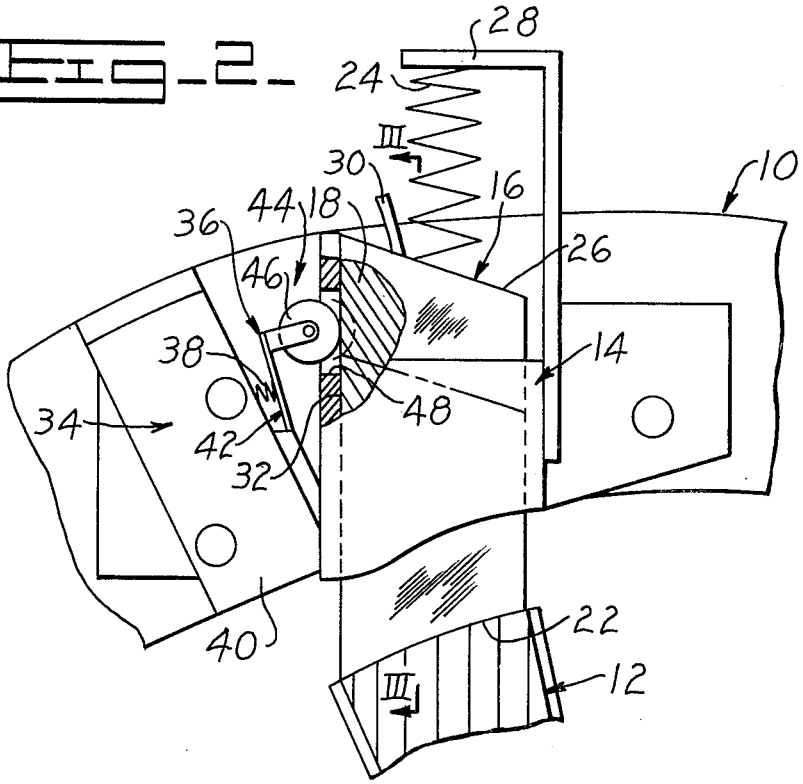
FIG. 2 is an enlarged view, partially in section, of a portion of the apparatus of FIG. 1.
Figure 3:
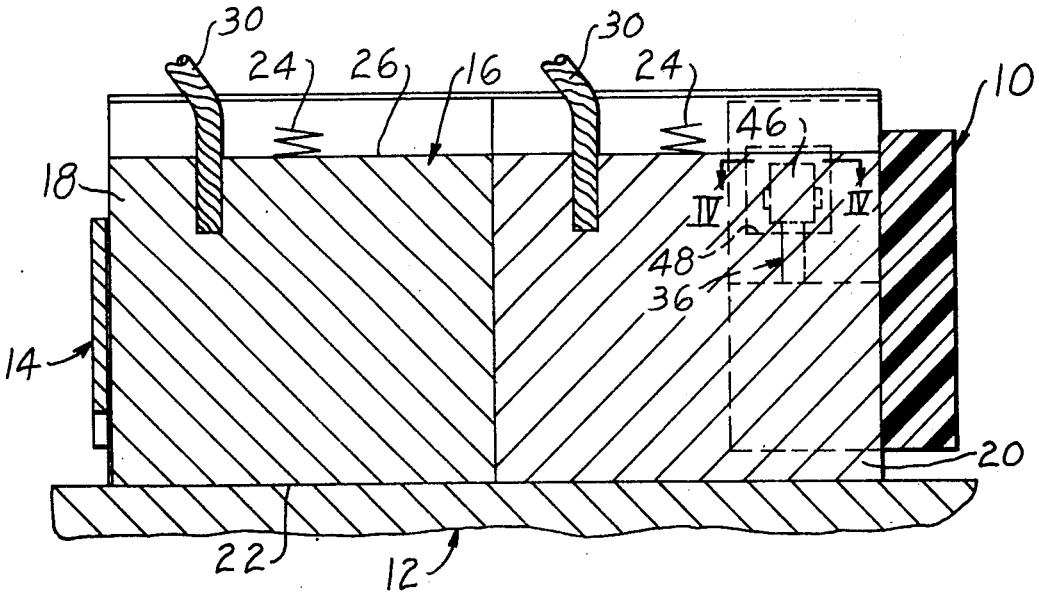
FIG. 3 is a sectional view taken along the line III—III of FIG. 2.
Figure 4:
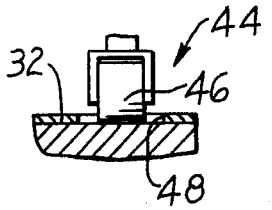
FIG. 4 is a sectional view taken along the line IV—IV of FIG. 3.

With reference to FIG. 2, it will be seen that each brush means 16 includes a generally straight side 32 interconnecting the contact face 22 and end 26 opposite the contact face 22. A microswitch 34 is included, being operatively associated with arm means 36 which are movable generally toward and away from the brush means 16 to determine respective closed and opened states of the microswitch 34. A resilient spring 38 interconnects the microswitch housing 46 and arm means 36 for urging the arm means 36 toward the brush 16. The arm means 36 include an arm 42, and an arm means portion 44 including a roller 46 in contact with the generally straight side 32 of the brush means 16, the roller 46 extending through an opening 48 in the brush holder 14. The rotational axis of the roller 46 is substantially perpendicular to the direction of translatory movement of the brush 16.

Figure 5:
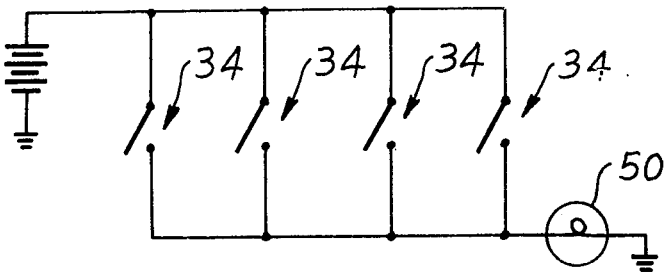
FIG. 5 is a schematic view of the electrical circuitry operatively coupled with the apparatus.

It is to be understood that each of the other brush means 16 and brush holders 14 include a microswitch 34 operatively coupled therewith in the same manner, with the four microswitches 34 being connected in parallel in accordance with FIG. 5.

Upon sufficient wear of, for example, the brush means 16 shown in FIG. 2, the roller 46 will be allowed to ride over the end 26 of the brush means 16 opposite the contact face 22, upon the end 26 reaching the roller 46, so that the arm 42 is moved under the resilience of the spring 38 to close the switch 34, to light a light 50 in the circuitry shown in FIG. 5, including a power source 52. Because the switches 34 are placed in parallel, the operator of the vehicle will be warned of an excessive state of wear of the first brush means 16 which so reaches that state.

It will be seen that the switches 34, being operatively connected with a power source 52, independent of brush current, do not rely on brush current for their operation. Thus, the present embodiment avoids any problem of voltage modification which might be necessary to properly operate a normal 12-volt lamp 50.

Because the roller 46 is allowed to roll onto the end 26 of the brush means 16 to an extent, the urging of the brush means 16 into operating contact with the commutator 12 by the spring 24 is not interfered with, even after the warning has been signaled to the operator. This will allow the machine to operate, meanwhile providing sufficient time to effect a brush change.

The embodiments of the invention in which an exclusive property or privilege is claimed are defined as follows:

1. In a brush wear indicator for a machine having a rotating commutator, a yoke surrounding said commutator, a brush holder on said yoke and carbon brush means mounted on said brush holder for translatory movement relative to said commutator, said brush means having a contact face spring-pressed against said commutator, an end opposite the contact face, and a generally straight side interconnecting the contact face and end opposite the contact face, the improvement comprising:

switch means including arm means movable generally toward and away from the brush means to determine respective closed and open states of the switch means, and resilient spring means operatively connected with the arm means, for urging the arm means toward the brush means, the arm means including an arm means portion in contact with the generally straight side of the brush means, whereupon with sufficient wear of the brush means, the end of the brush means opposite the contact face reaches the arm means portion in contact with the generally straight side of the brush means, allowing the resilient spring means to move the arm means to provide a closed state of the switch means.

2. The apparatus of claim 1 wherein the arm means portion in contact with the generally straight side of the brush means extends through an opening in the brush holder.

3. The apparatus of claim 1 wherein the arm means portion in contact with the generally straight side of the brush means comprise a roller.

4. The apparatus of claim 3 wherein the rotational axis of the roller is substantially perpendicular to the direction of translatory movement of the brush means.

5. The apparatus of claim 4 wherein the arm means portion in contact with the side of the brush means extends through an opening in the brush holder.

6. In a brush wear indicator for a machine having a rotating commutator, a yoke surrounding said commutator, a brush holder on said yoke and carbon brush means mounted on said brush holder for translatory movement relative to said commutator, said brush means having a contact face spring-pressed against said commutator, switch means operatively associated with the brush means and movable to determine respective open and closed states of the switch means in response to translatory movement of the brush means, power source means operatively associated with the switch means and indicator means operatively associated with the switch means, the switch means being closable to provide actuation of the indicator means by the power source means and openable to provide deactuation of the indicator means by cutting off the indicator means from the power source means, the operation of the indicator means being dependent on the power of the power source means, and being independent of current in the brush means.

7. The apparatus of claim 6 wherein the brush means include an end opposite the contact face, and a side interconnecting the contact face and end opposite the contact face, and wherein the switch means include arm means movable generally toward and away from the brush means to determine respective closed and open states of the switch means, and resilient spring means operatively connected with the arm means for urging the arm means toward the brush means, the arm means including an arm means portion in contact with the side of the brush means, whereupon with sufficient wear of the brush means, the end of the brush means opposite the contact face reaches the arm means portion in contact with the side of the brush means, allowing the resilient spring means to move the arm means to provide a closed state of switch means.

8. The apparatus of claim 7 wherein the arm means portion in contact with the side of the brush means extends through an opening in the brush holder.

* * * * *